US010373567B2

(12) United States Patent
Bae et al.

(10) Patent No.: US 10,373,567 B2
(45) Date of Patent: Aug. 6, 2019

(54) METHOD OF PROVIDING ADDITIONAL INFORMATION ON EACH OBJECT WITHIN IMAGE BY DIGITAL INFORMATION DISPLAY DEVICE, DIGITAL INFORMATION DISPLAY DEVICE FOR THE SAME, AND VISIBLE LIGHT COMMUNICATION TERMINAL FOR RECEIVING ADDITIONAL INFORMATION

(71) Applicant: Samsung Electronics Co. Ltd., Suwon-si, Gyeonggi-do (KR)

(72) Inventors: Tae-Han Bae, Seoul (KR); Seung-Hoon Park, Seoul (KR); Jae-Seung Son, Suwon-si (KR); Eun-Tae Won, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 655 days.

(21) Appl. No.: 13/762,933

(22) Filed: Feb. 8, 2013

(65) Prior Publication Data

US 2013/0208027 A1 Aug. 15, 2013

(30) Foreign Application Priority Data

Feb. 10, 2012 (KR) ..... 10-2012-0013905

(51) Int. Cl.
*G09G 3/34* (2006.01)

(52) U.S. Cl.
CPC ..... *G09G 3/3406* (2013.01); *G09G 3/3426* (2013.01)

(58) Field of Classification Search
CPC ..... G09G 3/3406; G09G 3/3426
See application file for complete search history.

(56) References Cited

U.S. PATENT DOCUMENTS

2005/0219198 A1* 10/2005 Pasqualini ..... G09G 3/3406 345/102
2006/0103621 A1* 5/2006 Feng ..... G09G 3/3426 345/102

(Continued)

FOREIGN PATENT DOCUMENTS

KR 10-2009-0076032 A 7/2009
KR 10-2011-0029733 A 3/2011
WO WO2006011515 * 2/2006 ..... G09G 3/003

OTHER PUBLICATIONS

The Korean Intellectual Property Office Notification of the Reasons for Rejection dated Apr. 10, 2018, issued in the Korea Application No. 10-2012-0013905.

*Primary Examiner* — Nitin Patel
*Assistant Examiner* — Robert M Stone
(74) *Attorney, Agent, or Firm* — Jefferson IP Law, LLP

(57) ABSTRACT

A method and apparatus for providing additional information to a visible light communication terminal through visible light communication by an information display device having a back light unit is provided. The method includes, when the visible light communication terminal is located in one area corresponding to at least one additional information providing area that is disposed within a screen of the information display device, receiving time slot information allocated to the one area through the visible light communication, when the visible light communication terminal is located in remaining areas of the at least one area corresponding to the at least one object, except for the one area, receiving additional information on all objects from the remaining areas through the visible light communication, and acquiring additional information on the object corresponding to the one area from among the additional information on all the objects by using the allocated time slot information.

9 Claims, 10 Drawing Sheets

(56) References Cited

U.S. PATENT DOCUMENTS

2007/0058987 A1* 3/2007 Suzuki ..... H04B 10/116 398/183
2008/0055228 A1* 3/2008 Glen ..... G09G 3/3406 345/102
2008/0284696 A1* 11/2008 Rosenblatt ..... G02F 1/1336 345/87
2009/0022112 A1* 1/2009 Shin ..... H04B 10/1149 370/336
2009/0175594 A1* 7/2009 Ann ..... H04N 7/025 386/357
2009/0213063 A1* 8/2009 Shimura ..... G09G 3/342 345/102
2011/0014955 A1* 1/2011 Kim ..... G02F 1/133603 455/566
2011/0063510 A1* 3/2011 Lee ..... G02F 1/133605 348/563
2011/0064405 A1* 3/2011 Rajagopal ..... H04B 10/114 398/43
2011/0216049 A1* 9/2011 Jun ..... G09G 3/36 345/207
2011/0294433 A1* 12/2011 Matsubara ..... H04M 1/7253 455/41.3
2013/0027423 A1* 1/2013 Bae ..... G09G 3/3413 345/619
2013/0040567 A1* 2/2013 Matsubara ..... G06F 3/0488 455/41.1
2013/0109310 A1* 5/2013 Mine ..... G06F 3/0488 455/41.1
2013/0208027 A1* 8/2013 Bae ..... G09G 3/3406 345/690
2014/0023378 A1* 1/2014 Bae ..... G06Q 30/02 398/128
2014/0178080 A1* 6/2014 Chen ..... H04B 10/116 398/172
2014/0186049 A1* 7/2014 Oshima ..... H04B 10/1143 398/118
2015/0065046 A1* 3/2015 Wilfred ..... H04W 76/14 455/41.2

* cited by examiner

METHOD OF PROVIDING ADDITIONAL INFORMATION ON EACH OBJECT WITHIN IMAGE BY DIGITAL INFORMATION DISPLAY DEVICE, DIGITAL INFORMATION DISPLAY DEVICE FOR THE SAME, AND VISIBLE LIGHT COMMUNICATION TERMINAL FOR RECEIVING ADDITIONAL INFORMATION

PRIORITY

This application claims the benefit under 35 U.S.C. § 119(a) of a Korean patent application filed on Feb. 10, 2012 in the Korean Intellectual Property Office and assigned Serial No. 10-2012-0013905, the entire disclosure of which is hereby incorporated by reference.

BACKGROUND OF THE INVENTION

1. Field of the Invention

The present invention relates to a visible light communication terminal and a control method thereof. More particularly, the present invention relates to an apparatus and a method for providing additional information to a visible light communication terminal by using an information display device having a Light Emitting Diode (LED) backlight.

2. Description of the Related Art

In general, visible light communication may be achieved by using a transmitter that transmits visible light by using a Light Emitting Diode (LED), a Laser Diode (LD), or any suitable light emitting device, as a light source and a receiver that processes the visible light by using a Photo Detector (PD), or any suitable light receiving device. As emission efficiency of the LED has improved and its cost reduced, the LED is becoming more commonly used in a general illumination market for lighting devices such as a fluorescent light, an incandescent light and the like, as well as in a special illumination market for lighting devices used in a portable device, a display, an automobile, a traffic light, a signboard and the like.

More particularly, a market for large size signboards has continuously grown. In the market for the large size signboards, use of signboards using a large size Liquid Crystal Display (LCD) screen has also continuously grown. Such a signboard may be referred to as a Digital Information Display (DID), a Digital Signage (DS), a Large Format Display (LFD), and other similar names for large electronic signboards. For example, a DID device may be used for information transmission using bidirectional communications between a user and a supplier by combining functions of a notice provided by using a paper medium and a unidirectional advertisement that is provided through broadcasting shown on a display and use of Information Technology (IT). Such a use of a DID device may reduce a cost in comparison with a related-art delivery medium of such information from a long-term point of view. The DID technology may be used in an outside advertisement and may have 3-Dimensional (3D) fields, and users may easily view advertisement media to which a DID technology is applied.

In a case where a user is viewing a DID display that is displaying an image, in order to select an object included in the image, various information display devices having a display unit as well as the DID device may configure a separate menu for selecting the object and may receive a user's selection of a particular object from an information list that corresponds to the object and that is provided to the user. Then, the user may select the menu for selecting the object in order to identify the list displayed on the screen and may select the particular object from the list in order to identify additional information.

The display device of the DID device may include the LED as a back light unit for illumination. Since the LED may be used as a light source for visible light communication, research should be conducted on the information display device that has more convenient and various functions by using the back light unit adopting the LED.

Therefore, a need exists for a system and method for an apparatus and a method for providing additional information to a visible light communication terminal by using an information display device having an LED backlight.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide an information display device including the back light unit adopting the Light Emitting Diode (LED) in order to provide visible light communication.

Furthermore, the information display device providing the visible light communication provides an image to a plurality of users in a public place or the like. Accordingly, an aspect of the present invention is to provide a visible light communication environment that allows a plurality of users to individually select a desired object through the information display device serving the plurality of users. Also, an aspect of the present invention is to provide an environment where additional information on particular objects desired by a plurality of users may be individually provided. Accordingly, a method of efficiently providing additional information on an object included in the image displayed on the screen of the current information display device by applying a visible light communication scheme is provided. Therefore, an aspect of the present invention is to provide an apparatus and a method in which the information display device provides additional information to the visible light communication terminal through the visible light communication.

Furthermore, an aspect of the present invention is to provide a method and an apparatus in which a plurality of users may individually select a desired object included in the image in the information display device applying the visible light communication scheme in order to receive additional information on the selected object.

In accordance with an aspect of the present invention, a digital information display device for providing additional information on each object within an image is provided. The digital information display device includes a display unit for outputting an image including at least one object, a back light unit including a plurality of light sources located in a back surface of the display unit, a controller for configuring a basic frame, the basic frame including all additional information on each object, and for allocating a transmission position for each object, the transmission position being a respective location in the basic frame where additional information on each object is respectively transmitted, and a back light unit driver for controlling the back light unit such that the basic frame is transmitted in a visible light form through all of the plurality of light sources of the back light unit and the transmission position is transmitted through at least one light source corresponding to each object.

In accordance with another aspect of the present invention, a method of receiving additional information from a digital information display device by a visible light communication terminal is provided. The method includes, when the visible light communication terminal is located in one area of at least one area corresponding to at least one object displayed on a screen of the digital information display device, receiving time slot information allocated to the one area through visible light communication, when the visible light communication terminal is located in remaining areas of the at least one area corresponding to the at least one object, except for the one area, receiving additional information on all objects from the remaining areas through the visible light communication, and acquiring additional information on the object corresponding to the one area from among the additional information on all the objects by using the allocated time slot information.

In accordance with another aspect of the present invention, a method of providing additional information on each object within an image by a digital information display device is provided. The method includes outputting an image including at least one object; configuring a basic frame including all additional information on the at least one object, determining whether a visible light communication terminal is located in one area of at least one area illuminated through a light source of a back light unit, each of the at least one area respectively corresponding to one of the at least one object, when the visible light communication terminal is located in the one area, providing, in a visible light form, identification information identifying additional information corresponding to an object that corresponds to the one area by controlling flickering of a light source of the back light unit corresponding to the one area, the identification information being provided among all the additional information included in the basic frame, and transmitting, to visible light communication terminals located in the remaining areas, the basic frame by controlling flickering light sources of the back light unit, the flickering light sources corresponding to remaining areas except for the area corresponding to the one object.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The following detailed description provides representative exemplary embodiments of the present invention to address the technical problems. Further, for the convenience of descriptions, terms defined in visible light communication will be used, but the standard and names do not limit the scope of the present invention.

The present exemplary embodiments provide a method of providing additional information to a visible light communication terminal using visible light communication in an information display device that has a back light unit. To this end, the present exemplary embodiments may include steps of, when the visible light communication terminal is located in one area of one or more additional information providing areas within the screen of the information display device, receiving time slot information allocated to the one area through visible light communication and then receiving additional information corresponding to the time slot information among all additional information from the remaining areas, except for the one or more additional information providing areas, through the visible light communication. Accordingly, the present exemplary embodiments provide an apparatus and method to efficiently transmit data by providing only brief information on a desired object respectively through each part of the screen of the information display device and additional information on all objects included in the image through a whole screen.

Figure 1:
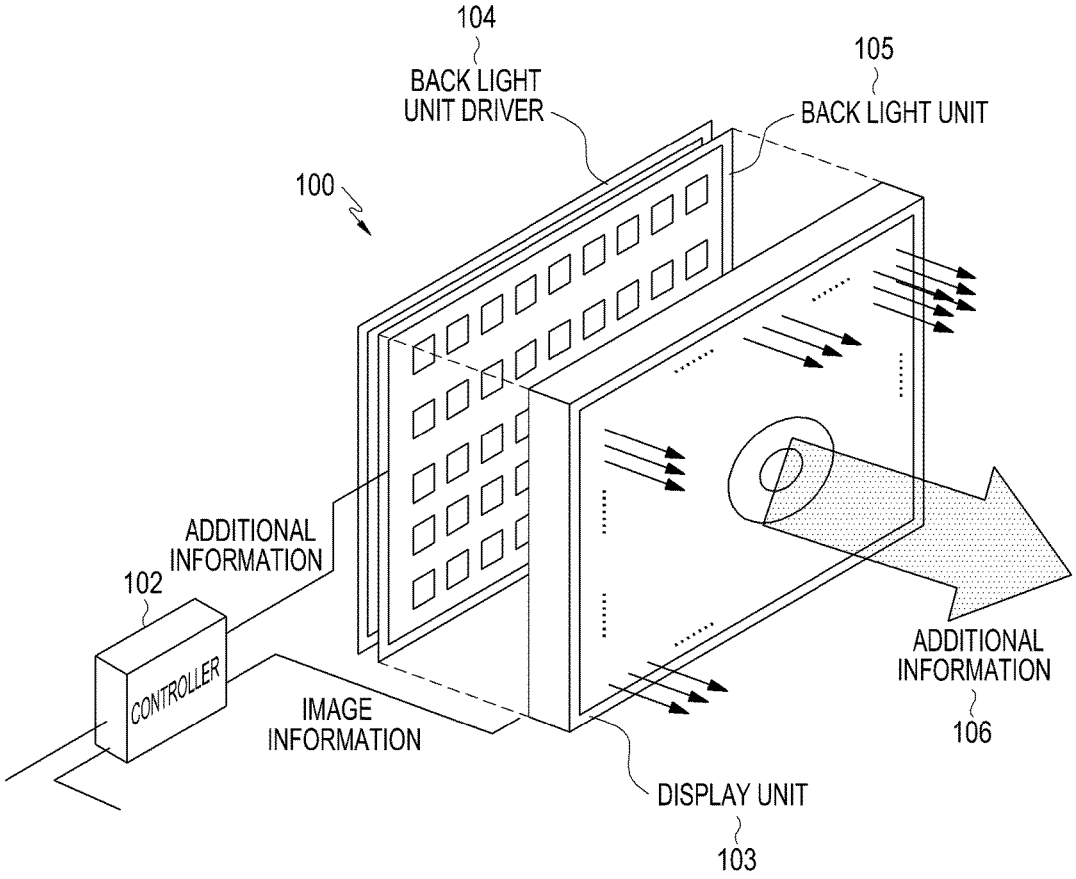
FIG. 1 illustrates a system for providing additional information using visible light communication according to an exemplary embodiment of the present invention.

FIG. 1 illustrates a system for providing additional information using visible light communication according to an exemplary embodiment of the present invention.

Referring to FIG. 1, a Liquid Crystal Display (LCD) is used as a display unit 103 of an information display device 100. The information display device 100 may also include a back light unit 105 having a light source for irradiating a light from a back surface of an LCD panel, a power circuit for driving the light source, and other elements used for achieving a uniform flat light. The back light unit 105 may also include a plurality of Light Emitting Diodes (LEDs) that are not shown.

Since the visible light communication terminal of a visible light communication system uses LEDs, when LEDs included in the back light unit 105 of the information display device 100 are used as the light source, then the information display device 100 may operate as a transmission side of the visible light communication system without a separate LED for the visible light communication.

The exemplary embodiment shown in FIG. 1 is a basic structure for performing the visible light communication, and a visible light transmission function of the information display device 100 will be described below. In the exemplary embodiments described herein, all devices having a display unit using the LED, such as a Digital Information Display (DID), a Digital Signage (DS), a Large Format Display (LFD), or any other similar and/or suitable display unit and/or device using the LED as the back light unit, may be considered to be the information display device 100.

A controller 102 may serve to control a general function of the information display device 100 and may determine a transmission method of the additional information to be transmitted using visible light communication, a modulation and coding scheme, and may control overall operations of the information display device 100.

Accordingly, the controller 102 may transmit image information to a display unit 103 in order to control the display unit 103 and may transmit additional information for visible light communication to a back light unit driver 104. A screen may be configured according to the image information, and then the image may be output. The back light unit driver 104 may transmit additional information 106 corresponding to an object within the image in a visible light form by controlling a flickering of LEDs within the back light unit 105.

The additional information 106 may refer to detailed information corresponding to the object within the image that is output through the screen of the information display device and may be information such as a Uniform Resource Locator (URL) indicating a position where the information on the object is stored. However, the present invention is not limited thereto, and the additional information 106 may be any type of information corresponding to the object within the image. Furthermore, the object may have various forms, such as a person, an object, an icon, a sign, a symbol and any other similar and/or suitable form displayed in the image. For example, when a product advertisement image is displayed on the screen of the information display device 100, additional information may be detailed information on the product or a URL address of a website where the detailed information is shown and/or located. The additional information may be provided to the information display device 100 by a separate server or a service provider through a wired or wireless communication apparatus, device, and/or system, and the information display device 100 may include a memory for storing a program for determining an LED, from among the LEDs of the back light unit 105, that is driven in accordance with the object within the image.

The controller 102 may also configure a basic frame, including all additional information on each object included in the image, and allocates a transmission position where the additional information corresponding to each object is transmitted to each object that is included in the basic frame. Here, the transmission position may refer to time slot information indicating a time when the additional information on each object is transmitted in the basic frame.

In addition, while under control of the controller 102, the back light unit driver 104 may transmit a transmission position indicating a position of information associated with the object, is transmitted in a visible light form in the basic frame by driving the LED corresponding to the object position of the object, wherein the information may be additional information or any other suitable information corresponding to the object. As described above, the back light unit driver 104 may control the transmission position to be transmitted through the LED corresponding, wherein the transmission position corresponds to each object and controls the basic frame to be transmitted in the visible light form through the all remaining LEDs, except for the LED corresponding to each object.

Here, the control of the LED within the back light unit 105 may be achieved such that each individual LED may be controlled one by one or LEDs may be controlled in at least one unit of predetermined blocks. Furthermore, there may be a difference between methods of transmitting the additional information according to a function or condition of the information display device 100, and the back light unit driver 104 may identify a position of basic information that is related to the object that is to be output through the screen, and, thus, may drive the LED in the position and transmit the basic information. The basic information related to the object may refer to information which may identify only the additional information on the object from among all additional information transmitted through the whole screen, and time slot information that is an example of basic information. Furthermore, the back light unit driver 104 controls all additional information to be transmitted through the remaining LEDs except for the LED corresponding to each object.

According to the present exemplary embodiments, the methods of transmitting the additional information may be classified according to a method of arranging LEDs of the back light unit. However, the present invention is not limited thereto, and the method of transmitting the additional information may be classified according to any suitable method and/or means. The back light unit 105 may be classified as a direct type or an edge type according to the method of arranging the LEDs in a relationship with the LCD panel corresponding to the display unit 103. However, the present invention is not limited thereto, and the back light unit 105 may be any suitable and/or similar type of back light device. FIG. 1 illustrates an LED array form that is the direct type, however the present invention may be applied to a LED arranging method in the edge type where the LEDs are located in a side surface of the LCD panel.

Meanwhile, in a case where additional information is to be transmitted by using a part of the screen, when amounts of the additional information to be transmitted are large or amounts of the LED light sources corresponding to a part of the amounts of the additional information are small, it may take a lot of time to transmit data. Therefore, the present exemplary embodiments provide a method of transmitting a small amount of data through the LED light source in an object position and transmitting a large amount of data through all the remaining LED light sources except for the LED light source that is disposed at the object position by considering the above provided descriptions. Accordingly, the user of the visible light communication terminal may put the visible light communication terminal on the object position, may receive basic information related to the object through the LED light source in the object position, and may then receive much more additional information through the LED light sources in the whole screen position except for the LED light sources disposed at the object position.

To this end, while under the control of the controller 102, the back light unit driver 104 may control all additional information to be transmitted through all the LED light sources except for the LED light source that is disposed at the object position. Here, the additional information may include additional information on each object, wherein the additional information on each object may be classified for each time slot. Accordingly, the basic information provided in each object position may contain time slot information at a time when the additional information on each object is actually transmitted through the whole screen. Furthermore, each of the basic information may include partial additional information on each object.

As described above, in the present exemplary embodiments, only brief information on the desired object is provided through each part of the screen, and additional information on all objects is provided through the whole screen, so that it is possible to efficiently use all LED light sources and also rapidly transmit a large amount of data. Furthermore, a majority of users may receive data through the whole screen by using their terminals as well as the minority of users. Accordingly, not only do the minority of users receive large capacity information from the information display device, but also the majority of users receive data classified by the time slot through the whole screen by using their terminals and then each terminal may acquire data corresponding to a desired time slot from the data.

In addition to the above described components, the information display device 100 may further include a light receiving element for receiving an additional information request from the visible light communication terminal. The light receiving element may convert a visible light signal from the visible light communication terminal into an electrical signal. For example, an image sensor, a photodiode or and any other similar and/or suitable device may be used as the light receiving element. As described above, the information display device 100 may operate as a transmission side of the visible light communication system without a separate device, and may perform all transmission and/or reception functions of the visible light communication when including the light receiving element.

Hereinafter, an example of providing additional information for each of the various object positions within the image of the information display device according to an exemplary embodiment of the present invention will be described with reference to FIG. 2.

Figure 2:
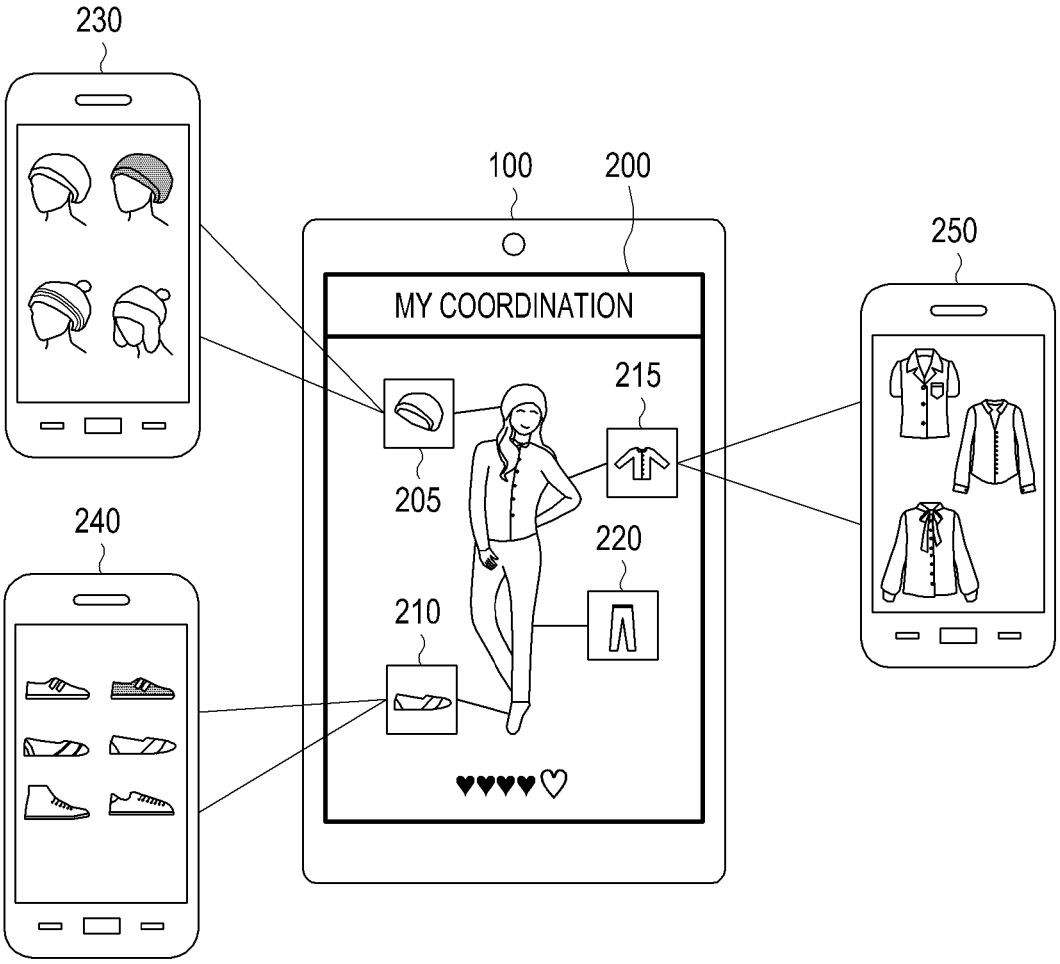
FIG. 2 illustrates a service model for providing additional information in various object positions within a screen of an information display device according to an exemplary embodiment of the present invention.

FIG. 2 illustrates a service model for providing additional information in various object positions within a screen of an information display device according to an exemplary embodiment of the present invention.

Referring to FIG. 2, the information display device 100 may include a screen 200 having object areas 205, 210, 215, and 220 that provide different additional information to visible light communication terminals 230, 240, and 250 by individually driving LEDs within a back light unit of the information display device 100.

Here, each of the object areas 205, 210, 215, and 220 may correspond to an area where basic information on each object is transmitted in a visible light form through an LED light source, which may also be referred to as a visible light activation area. Accordingly, when the visible light communication terminals 230, 240, and 250 are located in cells illuminated by the LEDs of the visible light activation areas 205, 210, 215, and 220 in order to acquire basic information and then are located in cells illuminated by the LEDs of the remaining areas, except for the visible light activation areas 205, 210, 215, and 220 within the screen 200, then the visible light communication terminals 230, 240, and 250 may acquire detailed additional information corresponding to the previously acquired basic information. As described above, the user acquires the actual additional information on the desired object through the screen using all the LEDs. The acquired additional information on the corresponding object may be output on screens of the visible light communication terminals 230, 240, and 250. Positions and types of the visible light activation areas 205, 210, 215, and 220 may adaptively vary depending on the object position and object type within the image as illustrated in FIG. 2.

As described above, at least one of a hat, clothes, shoes or the like may be designated as the object in the image displayed in the information display device 100, and the information display device 100 may transmit basic information or partial additional information, together with the basic information, through the LEDs of the areas where the hat, clothes, and shoes are located within the image.

Figure 3:
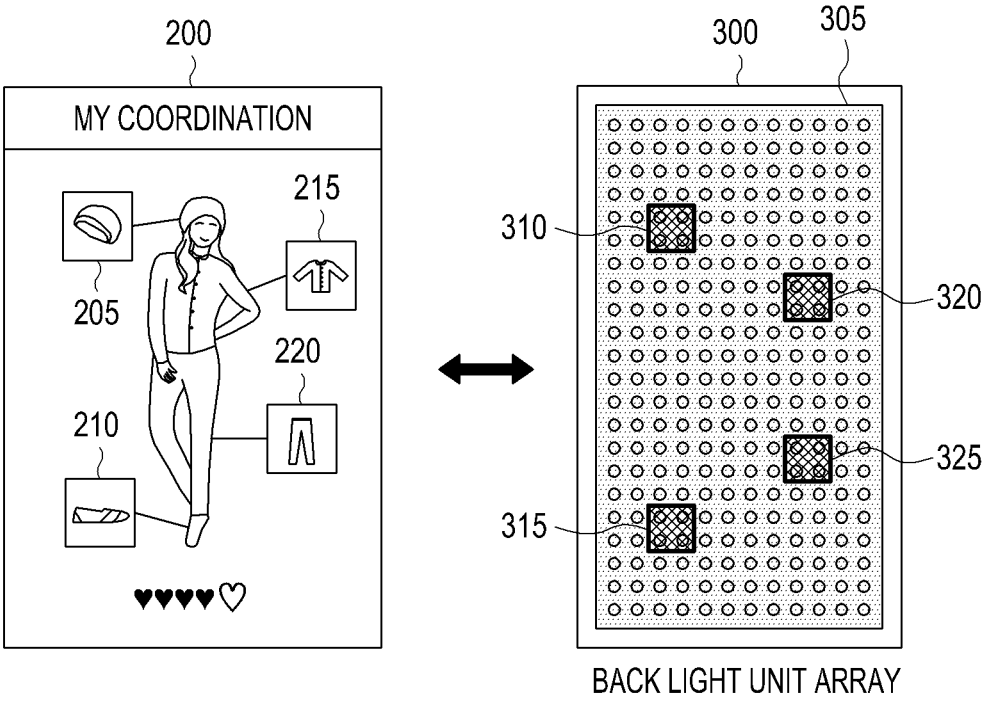
FIG. 3 illustrates a configuration of a back light unit, corresponding to the screen of FIG. 2, according to an exemplary embodiment of the present invention.

FIG. 3 illustrates a configuration of a back light unit, corresponding to the screen of FIG. 2, according to an exemplary embodiment of the present invention.

Referring to FIG. 3, a back light unit 305 having a configuration 300 corresponding to the screen 200 of FIG. 2 is shown. The user may view the screen 200 as shown in FIG. 2, and a plurality of LEDs is arranged in the back light unit 305. Accordingly, when the basic information is transmitted in the visible light form in each of the object areas 205, 210, 215, and 220 within the screen 200, then the LEDs 310, 315, 320, and 325 of the back light unit 305 are driven. Although FIG. 3 illustrates that the LEDs of the back light unit 305 are driven in the unit in a manner corresponding to predetermined blocks, the present invention is not limited thereto, and an individual LED may be driven one by one instead of any one of the predetermined blocks. That is, the LEDs of the back light unit 305 may be driven individually or in the unit of predetermined blocks.

Hereinafter, operations of the information display device and the visible light communication terminal will be described in detail. According to the operations of the information display device 100 as a transmission and/or reception side of the visible light communication system, the operations of the visible light communication terminal may be changed. Accordingly, in the following description, the operations of the information display device 100 and the visible light communication terminal in a unidirectional mode, where the information display device operates only as the transmission side of the visible light communication system, and a bidirectional mode, where the information display device operates as the transmission and/or reception side, will be described separately.

Figure 4:
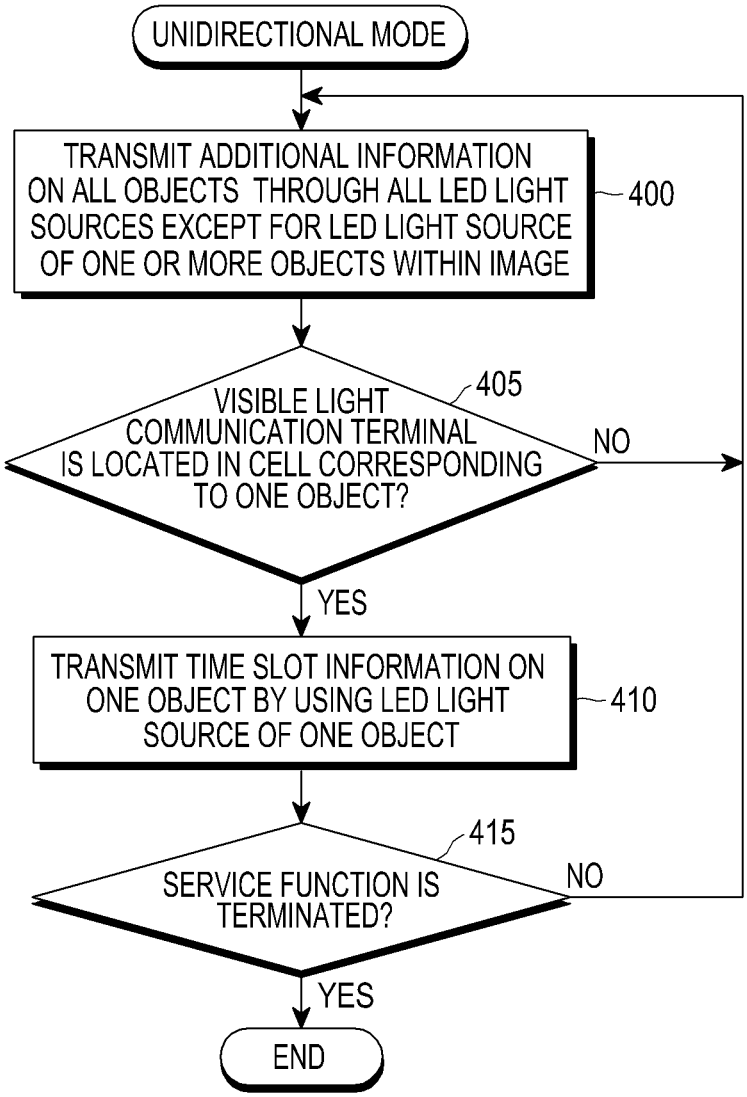
FIG. 4 is a flowchart of operations of an information display device in a unidirectional mode according to an exemplary embodiment of the present invention.

FIG. 4 is a flowchart of operations of an information display device in a unidirectional mode according to an exemplary embodiment of the present invention.

Referring to FIG. 4, the information display device 100 operating in the unidirectional mode may transmit additional information on all objects through all LED light sources, except for an LED light source of at least one object within the image, in step 400. At this time, since the information display device 100 is a medium or means for information delivery, such as advertisement delivery or the like, the additional information on the all objects may be continuously transmitted rather than being transmitted only one time. However, the present invention is not limited thereto, and the additional information may be transmitted in any suitable manner.

Next, the information display device 100 may determine whether the visible light communication terminal is located in a cell corresponding to one object in step 405. That is, the information display device 100 determines whether the visible light communication terminal is located within an area, such as a physical location, that illuminated by LEDs corresponding to the one object. Here, since the detection, by the information display device 100, of the visible light communication terminal entering the cell corresponding to the one object is performed through a general visible light communication method, a detailed description thereof will be omitted.

When the visible light communication terminal is located in the cell corresponding to the one object, then the information display device 100 may transmit time slot information corresponding to the one object by using the LED light source of the one object in step 410. Then, it is determined if a service function for transmitting information of the information display device 100 is terminated in step 415, and, if not, then the above described processes are repeated by returning to step 400.

Meanwhile, the operations of the visible light communication terminal for acquiring additional information on the desired object from one or more objects within the image will be described with reference to FIG. 5.

Figure 5:
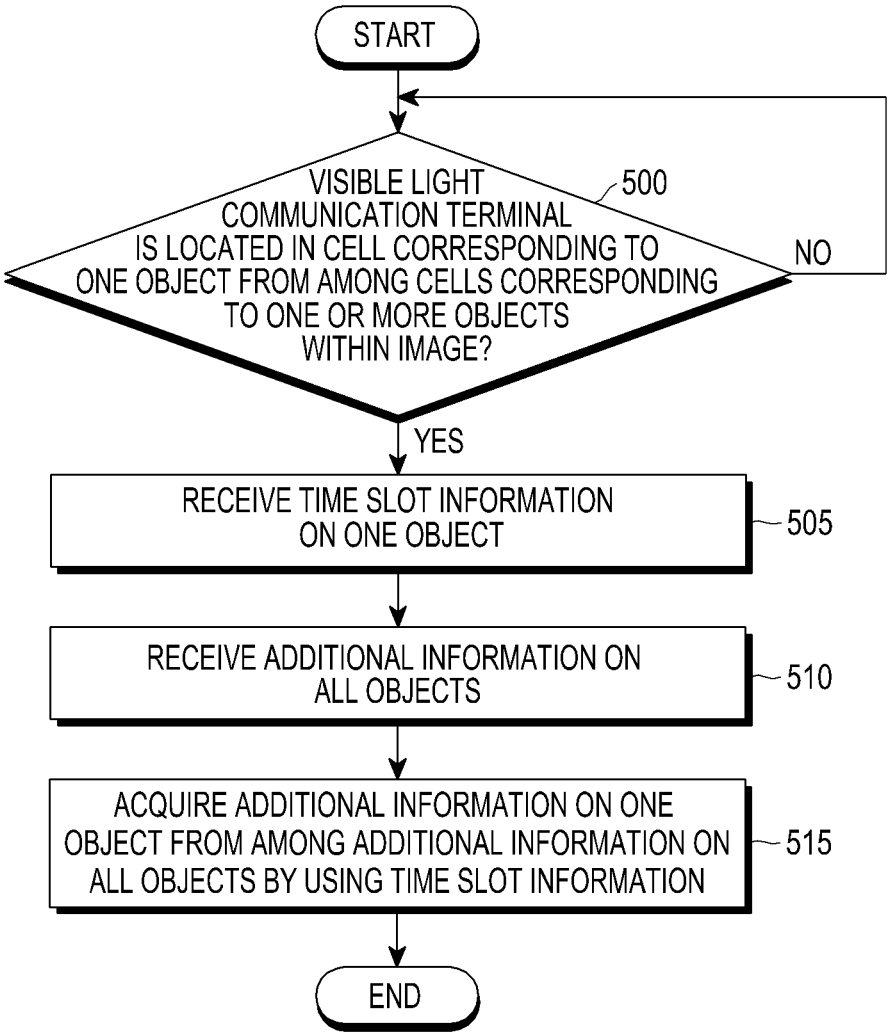
FIG. 5 is a flowchart of operations of a visible light communication terminal in a unidirectional mode according to an exemplary embodiment of the present invention.

FIG. 5 is a flowchart of operations of a visible light communication terminal in a unidirectional mode according to an exemplary embodiment of the present invention.

Referring to FIG. 5, it is determined whether the visible light communication terminal is located in a cell corresponding to one object from among cells corresponding to one or more objects within the image displayed on the information display device 100 in step 500. For example, the visible light communication terminal may know that it has entered the cell corresponding to the one object by receiving a beacon signal from the information display device 100. When the visible light communication terminal is located in the cell corresponding to the one object, then the visible light communication terminal may receive time slot information on the one object in step 505.

When receiving the time slot information, the visible light communication terminal should provide notification that the additional information should be received from the whole screen of the information display device 100 by using the received time slot information. To this end, after receiving the time slot information, the visible light communication terminal informs the user of the visible light communication terminal of the reception of the time slot information through a vibration, a sound, a screen or any other similar and/or suitable method. Through such a notification, the user may move the visible light communication terminal to a physical location corresponding to a screen area, except for a current object area, in order to receive the additional information from the whole screen. Accordingly, the visible light communication terminal may receive the additional information on all objects in step 510, and may acquire the additional information on one object from among the additional information on the all objects by using the time slot information in step 515.

As described with reference to the exemplary embodiment of FIG. 5, after taking the visible light communication terminal to the physical area displaying the desired object, the user may take the visible light communication terminal to another physical area when the notification informing that the time slot information has been acquired is received. When the visible light communication terminal receives the time slot information on the desired object and is then moved to the whole screen area by the user, the visible light communication terminal may acquire the additional information on the desired object from the additional information received through the whole screen. Alternatively, the user may first take the visible light communication terminal to every physical area corresponding to where each object is located, may collect time slot information, may receive all additional information received through the whole screen, and may then classify all the additional information for each object by using the collected time slot information.

Figure 6:
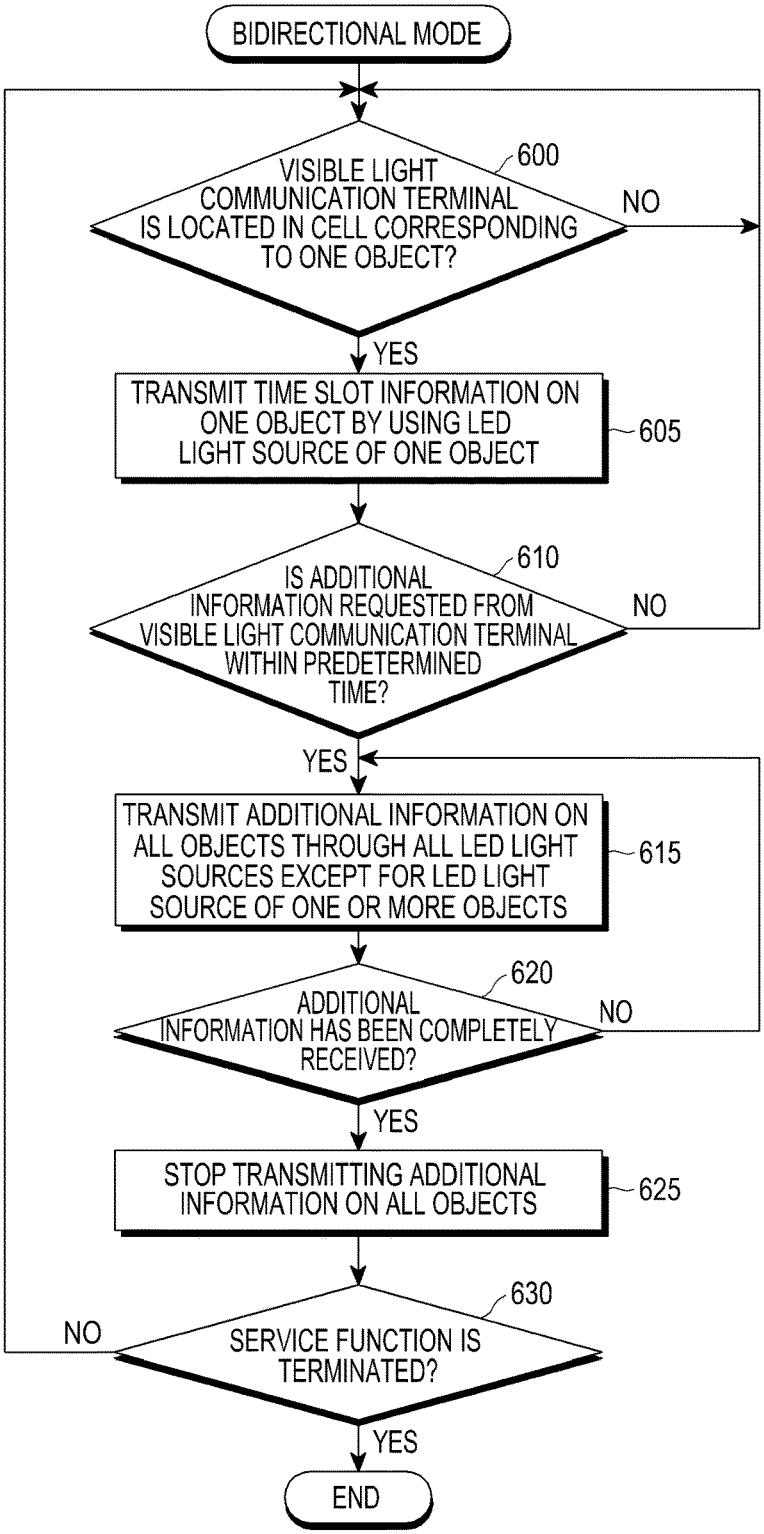
FIG. 6 is a flowchart of operations of an information display device in a bidirectional mode according to an exemplary embodiment of the present invention.

FIG. 6 is a flowchart of operations of an information display device in a bidirectional mode according to an exemplary embodiment of the present invention.

Referring to FIG. 6, the information display device 100 may determine whether the visible light communication terminal is located in a cell corresponding to one object in step 600. When the visible light communication terminal is located in the cell corresponding to the one object, then the information display device 100 may transmit time slot information on the object in a visible light form by using an LED light source corresponding to the one object in step 605. At this time, since the bidirectional mode has a function of receiving a request of the visible light communication terminal, the information display device 100 may start transmitting all the additional information after receiving the additional information request from the visible light communication terminal without the need for continuously transmitting all additional information like in the case of the unidirectional mode.

Accordingly, the information display device 100 may determine whether the additional information request is received from the visible light communication terminal within a predetermined time in step 610. When the additional information request has not been received within the predetermined time, the information display device 100 returns to step 600 in order to determine whether the visible light communication terminal is located in a cell corresponding to another object. When the additional information request has been received within the predetermined time, then the information display device 100 may start transmitting the additional information corresponding to all the objects through all LED light sources, except for an LED of one or more objects within the image, in step 615.

Subsequently, the information display device 100 may determine whether the additional information on the one object or the additional information on all the objects has been completely received by the visible light communication terminal in step 620. The determination of the reception completion may be achieved by receiving a notification message of informing that the additional information has been acquired from the visible light communication terminal. However, the present invention is not limited thereto, and the determination of the reception completion may be made by any suitable means. When it is determined that the additional information has been completely received by the visible light communication terminal, the information display device 100 proceeds to step 625 in order to stop transmitting the additional information on all the objects. Thereafter, it is determined if a service function is terminated in step 630, and, if not, then the information display device 100 returns to step 600 and repeats the above described processes.

Figure 7:
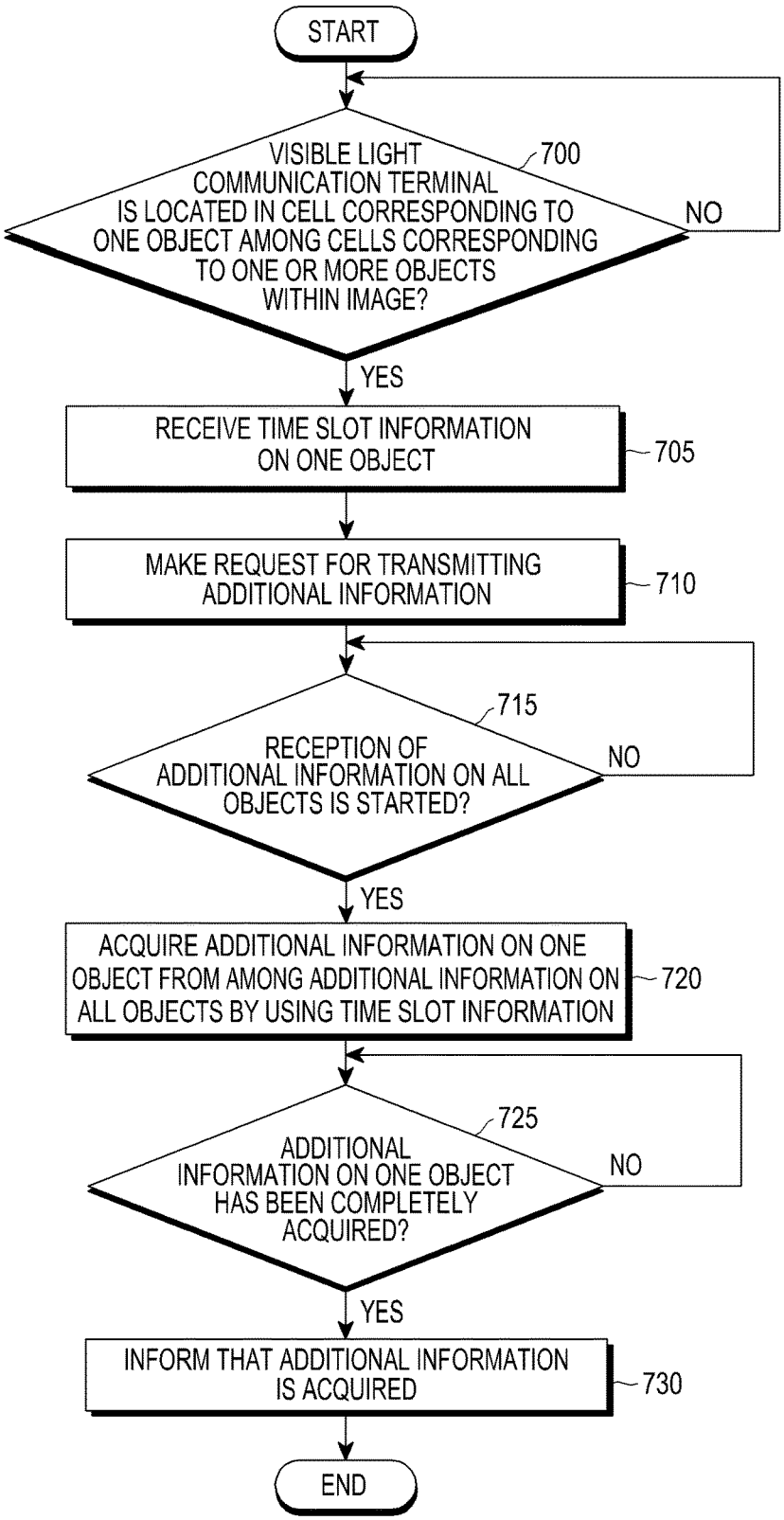
FIG. 7 is a flowchart of operations of a visible light communication terminal in a bidirectional mode according to an exemplary embodiment of the present invention.

FIG. 7 is a flowchart of operations of a visible light communication terminal in a bidirectional mode according to an exemplary embodiment of the present invention.

Referring to FIG. 7, since operations in steps 700 to 705 of FIG. 7 are similar to those in steps 500 to 505 of FIG. 5, detailed descriptions thereof will be omitted. In FIG. 7, when the visible light communication terminal receives the time slot information in step 705, then the visible light communication terminal may transmit an additional information request for acquiring additional information on a desired object in step 710. Since the information display device 100 has a reception function for receiving the visible light communication, the additional information request is possible. In response to transmission of the additional information request, the visible light communication terminal may determine whether reception of the additional information on all the objects has started in step 715. The operation in which the user takes the visible light communication terminal to physical areas, except for the physical area where the time slot information is received, in order to receive the additional information is the same as that as described with reference to the unidirectional mode.

Subsequently, the visible light communication terminal acquires additional information on one object, from among the additional information on all objects, by using the time slot information in step 720. That is, the visible light communication terminal may identify which part of the additional information on all the objects includes the additional information on the desired object according to the time slot information. Accordingly, the visible light communication terminal may determine whether the additional information on the one object has been completely acquired in step 725. When the visible light communication terminal completely acquires the additional information on the desired object, then the visible light communication terminal informs the information display device 100 that the additional information has been acquired in step 730, and thus, the information display device 100 may stop transmitting the additional information on all the objects. Alternatively, after completely acquiring the additional information on all the objects, the visible light communication terminal may make a request for stopping transmitting the additional information on the all objects.

Hereinafter, basic information provided in the object areas 205, 210, 215, and 220 of FIG. 3, for example, the time slot information and the additional information on all the objects, which may also be referred to as all additional information, that is provided in the remaining areas, except for the object areas 205, 210, 215, and 220, of the whole screen 200 will be described in detail.

Figure 8:
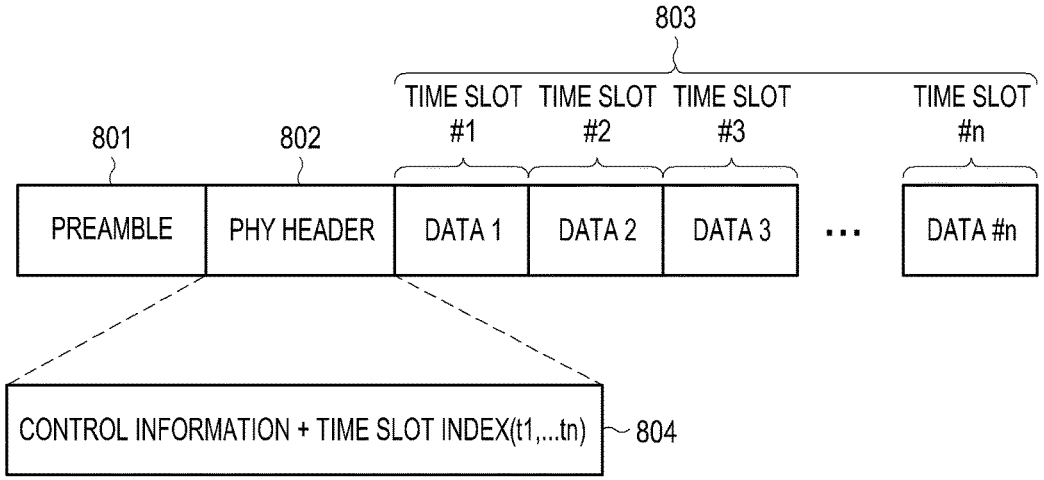
FIG. 8 illustrates a basic frame in a time division scheme for additional information transmission according to an exemplary embodiment of the present invention.

FIG. 8 illustrates a basic frame in a time division scheme for additional information transmission according to an exemplary embodiment of the present invention.

Referring to FIG. 8, the same frame structure as that illustrated in FIG. 8 may be used to transmit all additional information. A basic frame, as illustrated in FIG. 8, is a frame that may be used to transmit all additional information through the whole screen of the information display device 100.

Referring to FIG. 8, the frame for transmitting all additional information may include a preamble field 801, a PHY header field 802, and a plurality of data fields 803. First, the preamble field 801 may contain information for operation synchronization, and the PHY header field 802 may contain control information for communication, and the following data fields 803 may contain allocated time slot indexes 804. The plurality of data fields 803 may include a preset number of time slots, and the data fields may be separated for each time slot allocated to each object. Accordingly, time slots of the data field 803 may be allocated and used individually or as a group according to the number and size of additional information. The time slot may be allocated to each data field 803 in consideration of screen information, additional information, a size of the additional information, and the number of time slots which may be currently used. The frame structure may be used to transmit basic information through the object areas 205, 210, 215, and 220. The frame structure will be described in detail with reference to FIGS. 9 and 10.

Figure 9:
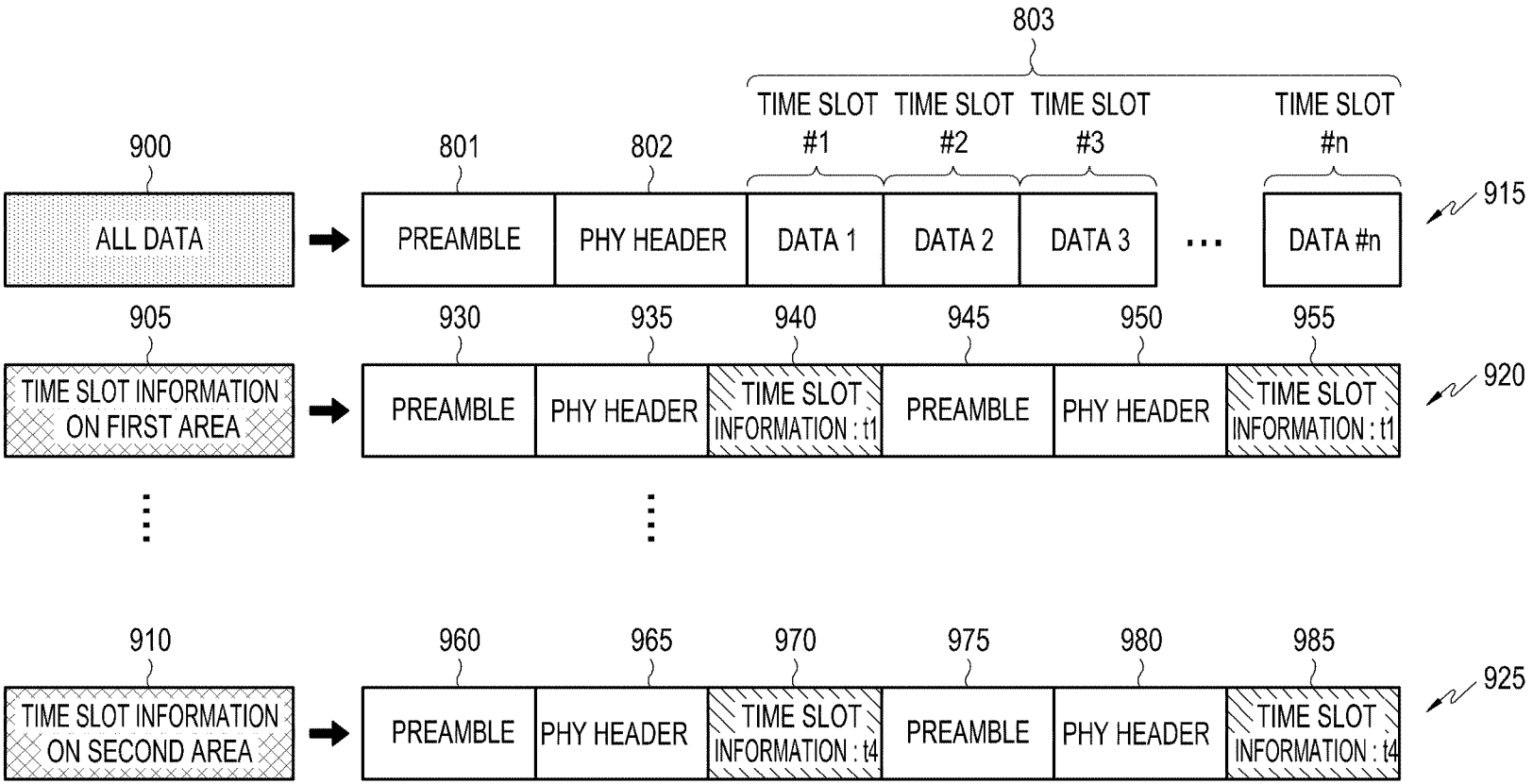
FIG. 9 illustrates frames provided through each part of a screen of an information display device according to an exemplary embodiment of the present invention.
Figure 10:
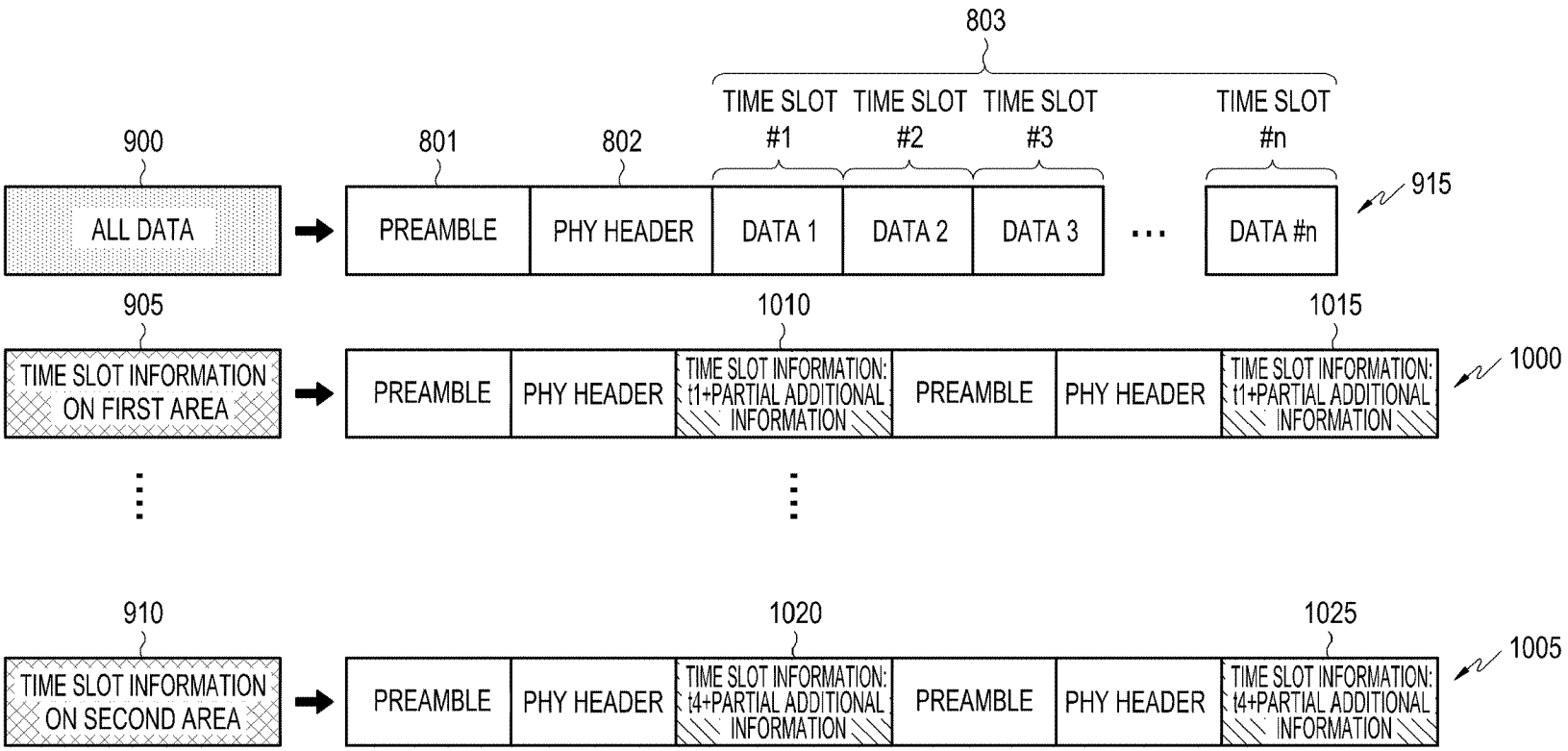
FIG. 10 illustrates frames provided through each part of a screen of an information display device according to a second exemplary embodiment of the present invention.

FIG. 9 illustrates frames provided through each part of a screen of an information display device according to an exemplary embodiment of the present invention, and FIG. 10 illustrates frames provided through each part of a screen of an information display device according to a second exemplary embodiment of the present invention. The following description will be made with reference to FIGS. 3, 9, and 10 in order to help understanding of the present exemplary embodiment.

Referring to FIG. 9, through the remaining areas of the whole screen 200, except for the object areas 205, 210, 215, and 220 of the whole screen 200, all additional information may be transmitted by the frame structure of FIG. 8. Here, all data 900 may refer to data transmitted through the remaining LEDs, except for the LEDs 310, 315, 320, and 325, which correspond to the object areas of the back light unit 305 and the all data 900 may have a structure of a basic frame 915 including the preamble field 801, the PHY header field 802, and the plurality of data fields 803 as described in FIG. 8.

Furthermore, each of the object areas 205, 210, 215, and 220 may have time slot information corresponding to each respective area. Time slot information on a first area 905 may be transmitted to the visible light communication terminal through a first frame structure 920 having at least one frame including information on an individual position, which contains additional information corresponding to the first area, from among the data fields of the basic frame 915. Similarly, time slot information on a second area 910 may have a second frame structure 925.

In the present exemplary embodiment, the time slot may have information on the position containing additional information on each object in the basic frame 915. The first frame structure 920 may include a first frame that includes a preamble 930, a PHY header 935, and time slot information (t1) 940 indicating a position of additional information, and the first frame may be followed by a second frame that includes a preamble 945, a PHY header 950, and time slot information (t1) 955. Accordingly, when the visible light communication terminal is located in the first area, the time slot information on the first area may be acquired from successively transmitted frames having the first frame structure 920. At this time, a number of frames for transmitting basic information on the object may be determined according to the number of all objects.

Furthermore, the second frame structure 925, which may be transmitted through the second area, includes a first frame having a preamble 960, a PHY header 965, and time slot information (t4) 970, and the first frame is followed by a second frame that has a preamble 975, a PHY header 980, and time slot information (t4) 985. The time slot information (t4) fields 970 and 985 may contain the time slot information 910 corresponding to the second area. Since the time slot information has a very small size, the visible light communication terminal may receive the time slot information through the corresponding object area, and may then acquire actual additional information on the object through the basic frame 915 that is transmitted from all LEDs by using the time slot information.

For example, when the screen 200 displays an information provision screen in the information display device 100, the basic frame 915 may be transmitted through most of the LEDs included in the back light unit 305. That is, the basic frame 915 may be transmitted through the LEDs of the back light unit 305 except for the LEDs 310, 315, 320, and 325, which correspond to the object areas 205, 210, 215, and 220. However, the present invention is not limited thereto, and there may be any number of object areas and any number of corresponding groups of at least one LED.

In this case, having four objects corresponding to the four object areas 205, 210, 215, and 220, the information device 100 may allocate time slots for the four objects in the basic frame 915 in order to determine the time slot and the additional information of the object that is to be transmitted in a determined time slot. For example, additional information on the hat, which corresponds to the object area 205 as shown in FIG. 2, is allocated to the time slot t1 and additional information on the shoes, which corresponds to the object area 210 is allocated to the time slot t4 in the basic frame 915. Accordingly, the information on the hat is transmitted as data 1 of time slot #1 and the information on the shoes is carried on data 4 of time slot #4 in the basic frame 915, wherein the transmitted information is transmitted through the LEDs of the back light unit 305. Furthermore, the frame transmitted through the partially driven LEDs 310, 315, 320, and 325 provides the additional information on the hat. Since the additional information on the hat is allocated to time slot #1 in the basic frame 915, a value of time slot 1 is transmitted in the first frame structure 920, which may also be referred to as a basic information provision frame.

As described above, a user may place the visible light communication terminal at a physical area and/or location that corresponds to a desired object area of the screen in an intuitive way, and thus, the user may receive desired time slot information and then may receive additional information through the whole screen for a short time. When a user desires to receive information on the hat, the user may move the visible light communication terminal to a physical position corresponding to the hat position on the screen 200, wherein the physical position corresponding to the hat is the object area 205 on the screen 200, so that the user may receive the time slot information 940 and 955 and then may receive the basic frame 915 through the whole screen 200. Accordingly, since the visible light communication terminal knows that there is additional information on the hat in the time slot t1, the visible light communication terminal may locate the data field corresponding to the time slot t1 according to the received basic frame in order to acquire the additional information on the hat from the data field.

Meanwhile, another exemplary embodiment of the present invention illustrates a case where partial additional information, as well as time slot information, may be included as basic information on each object area with reference to FIG. 10.

Referring to FIG. 10, the present exemplary embodiment is similar to the exemplary embodiment of FIG. 9, but has a difference in that partial additional information may be provided in addition to the time slot information. In this case, when the user receives brief information through a desired object area and then desires to receive or have more information, the user may acquire detailed additional information on the object through the whole screen 200.

As illustrated in FIG. 10, a first basic information provision frame 1000 includes partial additional information 1010 and 1015. As noted above, the basic information provision frame 1000 includes the time slot information on the first area is provided is similar to that the basic frame 915 but has a difference in that the time slot information further Also, a second basic information provision frame 1005 also has a similar structure to that of the basic frame 915, but the time slot information further includes partial additional information 1020 and 1025. Accordingly, after receiving a small amount of data in order to further grasp contents of more of the data, the user of the visible light communication terminal may receive a large amount of data according to the user's desire.

According to exemplary embodiments of the present invention, as the information display device includes a visible light communication device that includes the back light unit, the information display device may provide additional information to the visible light communication terminal by using the back light unit for visible light communications. Furthermore, according to the present exemplary embodiments, since the information display device transmits different information for each light source block, the user may select a desired object according to contents displayed on the screen in order to acquire additional information on the desired object.

Moreover, according to the present exemplary embodiments, it is possible to efficiently transmit data by first providing only brief information on a desired object through each part of the screen and then by providing additional information on all objects included in the image through the whole screen. As described above, the present exemplary embodiments provides a data transmission time that may be reduced by transmitting the data through the whole screen when an amount of data to be transmitted is large or a light source used for providing additional information is small.

It may be appreciated that the exemplary embodiments of the present invention can be implemented in hardware, or a combination of hardware and software. Any such software may be stored, for example, in a volatile or non-volatile storage device such as a Read Only Memory (ROM), a memory such as a Random Access Memory (RAM), a memory chip, a memory device, or a memory Integrated Circuit (IC), or a recordable optical or magnetic medium such as a Compact Disc (CD), a Digital Versatile Disc (DVD), a magnetic disk, or a magnetic tape, and any other similar and/or suitable non-transitory computer readable storage medium, regardless of its ability to be erased or its ability to be re-recorded. It may be also appreciated that the memory included in the mobile terminal is one example of machine-readable devices suitable for storing a program including instructions that are executed by a processor device to thereby implement exemplary embodiments of the present invention. Therefore, exemplary embodiments of the present invention may provide a program including codes for implementing a system or method claimed in any claim of the accompanying claims and a machine-readable device for storing such a program. Further, this program may be electronically conveyed through any medium such as a communication signal transferred via a wired or wireless connection, and exemplary embodiments of the present invention appropriately include equivalents thereto.

Furthermore, the communication terminal or display device may receive the program from a program providing apparatus connected to the device through a wired or wireless communication means and/or system and may store the program. The program providing apparatus may include a program including instructions through which the communication terminal or display device implements a preset content protecting method, a memory for storing information or the like that may be needed for the content protecting method, a communication unit for performing wired or wireless communication with the communication terminal or display device, and a controller for transmitting the corresponding program to the communication terminal or display device according to a request of the communication terminal or display device or automatically.

While the detailed description has been shown and described with reference to certain exemplary embodiments thereof, it will be understood by those skilled in the art that various changes in form and details may be made without departing from the scope of the present invention as defined by the appended claims and their equivalents.

What is claimed is:

1. A display device for providing additional information on each object, the display device comprising:

a display;

a back light including a plurality of light sources;

a light receiving element configured to receive an additional information request from a terminal; and at least one processor configured to:

transmit, if the terminal is positioned above a first area of the display, information for a time slot corresponding to additional information for a first object belonging to the first area to the terminal, and transmit, if the terminal is positioned above a second area different from the first area, additional information for a plurality of objects including the first object, wherein the back light is under a control of the at least one processor, wherein the information for the time slot is for informing existence of additional information for the first object, and information for identifying the additional information for the first object from among the additional information for the plurality of objects, and wherein, if the additional information request is received from the terminal, the at least one processor is configured to control to transmit the additional information.

2. The display device of claim 1, wherein, if the terminal is positioned above the first area, the at least one processor is further configured to provide partial additional information for the first object.

3. The display device of claim 1, wherein the additional information for the plurality of objects includes a preamble for a synchronization operation, a header including information for a time slot allocated to one or more data fields, the time slot allocated to each of the plurality of objects, and at least one data field having the additional information for the plurality of objects.

4. The display device of claim 1, wherein, if the additional information for the plurality of objects has been completely received, then the at least one light source is configured to stop transmitting the additional information for the plurality of objects.

5. A method of receiving additional information from a display device by a terminal, the method comprising:

receiving, if the terminal is positioned above a first area of a display of the display device, information for a time slot corresponding to additional information for a first object belonging to the first area from the display device;

informing a user of the terminal of a reception of the information for the time slot;

receiving, if the terminal is positioned above a second area different from the first area, additional information for a plurality of objects including the first object, wherein the additional information for the plurality of objects has a frame structure of a time division scheme including data fields on which the additional information for the plurality of objects is carried, and wherein the frame structure includes a preamble for a synchronization operation, a header including information for time slots allocated to the data fields, and at least one data field having the additional information; and displaying the additional information for the first object corresponding to the received information for the time slot on a display of the terminal;

wherein the information for the time slot is for identifying the additional information for the first object from among the additional information for the plurality of objects.

6. The method of claim 5, wherein the receiving of the information for the time slot comprises receiving the information for the time slot and partial additional information for the plurality of objects.

7. The method of claim 5, further comprising:

transmitting, to the display device, if the additional information for the plurality of objects has been completely received, a request for stopping transmission of the additional information for the plurality of objects.

8. A method of providing additional information on each object within an image by a display device, the method comprising:

transmitting, if a terminal is positioned above a first area of a display, information for a time slot corresponding to additional information for a first object belonging to the first area to the terminal; and transmitting, if the terminal is positioned above a second area different from the first area, additional information for a plurality of objects including the first object, wherein the additional information for the plurality of objects has a frame structure of a time division scheme including data fields on which the additional information for the plurality of objects is carried, and wherein the frame structure includes a preamble for a synchronization operation, a header including information for time slots allocated to the data fields, and at least one data field having the additional information, wherein the information for the time slot is for informing existence of additional information for the first object, and information for identifying the additional information for the first object from among the additional information for the plurality of objects.

9. The method of claim 8, further comprising:

stopping, if additional information for the plurality of objects has been completely received, transmitting the additional information for the plurality of objects.

* * * * *